United States Patent [19]

Gattu

[11] 4,298,128

[45] Nov. 3, 1981

[54] MOVABLE SUPPORT FOR ROTATABLE EXTEND/RETRACT SCREW IN TELESCOPIC CRANE BOOM

[75] Inventor: Narahari Gattu, Cedar Rapids, Iowa

[73] Assignee: Harnischfeger Corporation, W. Milwaukee, Wis.

[21] Appl. No.: 122,488

[22] Filed: Feb. 19, 1980

[51] Int. Cl.[3] ..... B66C 23/06

[52] U.S. Cl. ..... 212/267; 212/230; 212/264

[58] Field of Search ..... 212/187, 230, 231, 264, 212/267, 268, 184; 414/718

[56] References Cited

U.S. PATENT DOCUMENTS

| | | | |
|---|---|---|---|
| 3,174,634 | 3/1965 | Peck | 212/264 |
| 3,800,965 | 4/1974 | Barron et al. | 212/267 |
| 3,836,011 | 9/1974 | Sakamoto et al. | 212/268 |
| 4,169,338 | 10/1979 | Eik | 212/267 |

*Primary Examiner*—Lawrence J. Oresky
*Attorney, Agent, or Firm*—James E. Nilles

[57] ABSTRACT

A telescopic boom comprises inner and outer boom sections; an elongated rotatable screw rotatably mounted on the outer section; a first thread on the screw engaged with a first nut on the inner boom section whereby screw rotation effects telescopic movement of the inner boom section and a second thread of smaller lead superimposed on the first thread and engaged with a second nut mounted on a support which is movably mounted on the outer boom section whereby screw rotation also effects axial movement of the support at a slower rate than telescopic movement of the boom sections to a position wherein it supports the mid-section of the screw.

8 Claims, 4 Drawing Figures

MOVABLE SUPPORT FOR ROTATABLE EXTEND/RETRACT SCREW IN TELESCOPIC CRANE BOOM

BACKGROUND OF THE INVENTION

1. Field of Use

This invention relates generally to multisection telescopic crane boom having a rotatable screw for extending and retracting boom sections and, in particular, to movable support means for the screw.

2. Description of the Prior Art

U.S. Pat. No. 3,836,011 discloses a telescopic or extensible crane boom of a type wherein two boom sections are moved relative to each other by means of an elongated hydraulic cylinder unit disposed within the boom. In that extensible boom, a buckling-preventing support for the hydraulic cylinder unit is employed in the boom wherein an intermediate position of an optionally extendible piston-rod of the cylinder unit is always supported with a buckling-preventing support having legs slideably or rotatably engaged with inner circumference of a boom member. That patent further discloses driving means for the buckling-preventing device which moves the device to said intermediate position of the piston-rod in connection with the operation of the cylinder unit.

In some telescopic booms, however, wherein an elongated rotatable screw is employed instead of a hydraulic cylinder unit to extend and retract the boom sections, it is also sometimes necessary to provide support means for the screw but insofar as applicant is aware no such support means are known or available.

SUMMARY OF THE INVENTION

In accordance with the present invention, there is provided a multisection telescopic boom having at least one inner boom section telescopically receivable within an outer hollow boom section; an elongated screw rotatably mounted on the outer boom section by a screw mount and having a first thread thereon engaged with a first nut mounted on the inner boom section whereby screw rotation effects telescopic movement of the inner boom section; drive means for selectively rotating the screw in opposite directions; and adjustably movable support means for supporting the screw intermediate its ends on the outer boom section. The adjustably movable support means includes a second thread of smaller lead and lesser depth superimposed on the first thread of the screw and engaged with a second nut mounted on a support member which is located between said screw mount and second nut and which is movably supported on the outer boom section, preferably by means of rollers, whereby screw rotation also effects axial movement of the second nut and support member at a slower rate than the telescopic movement of the boom sections so as to position the support member intermediate the length of the screw.

The adjustably movable support means in accordance with the invention is particularly well adapted to support elongated screws used instead of hydraulic cylinder units in telescopic booms. The support provides more anti-buckling strength to the screw thereby allowing for use of a lighter screw for the required column load. The movable support automatically positions itself at or near the mid-portion of the screw to effect optimum support thereof regardless of boom section position. The support is constructed and operates to position itself with a minimum number of parts or components and is relatively easy and economical to fabricate and fool-proof in operation. Other objects and advantages of the invention will hereafter appear.

DESCRIPTION OF A PREFERRED EMBODIMENT

Figure 1:
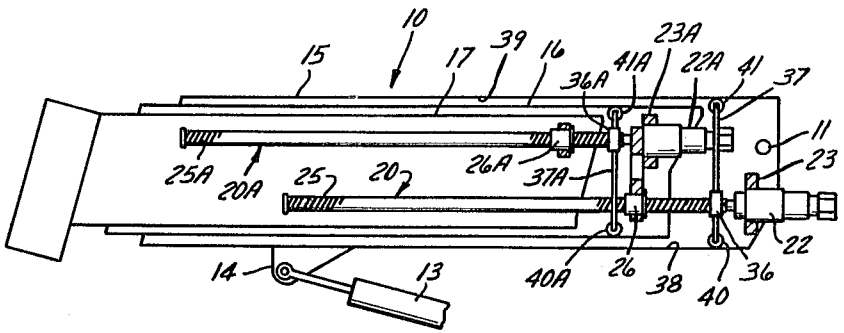
FIG. 1 is a side elevational view of a multisection telescopic crane boom having a movable support for a rotatable extend/retract screw therein in accordance with the invention and showing the boom retracted.
Figure 2:
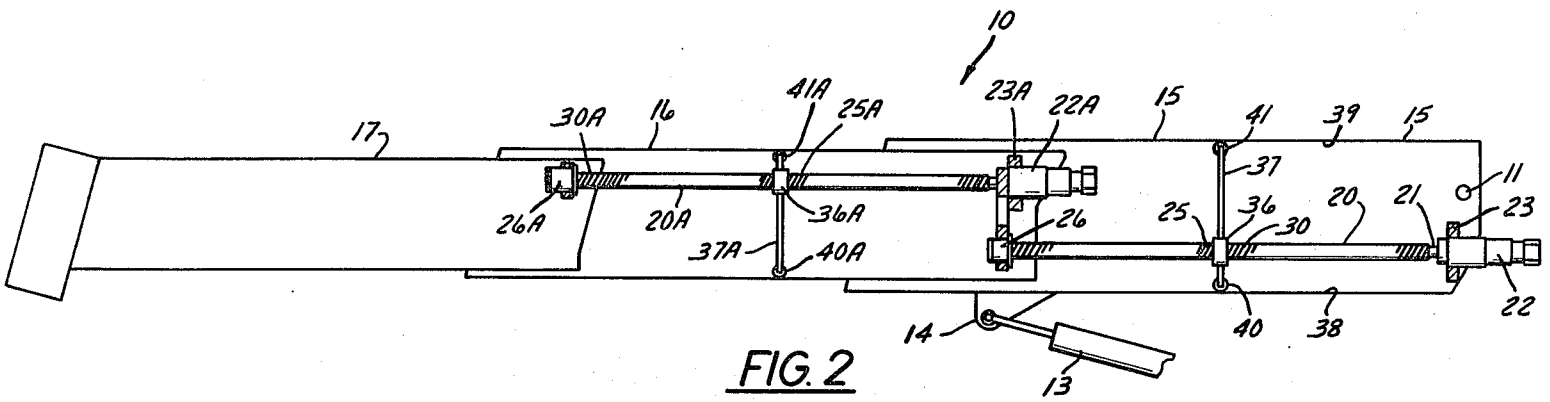
FIG. 2 is a view similar to FIG. 1 but showing the boom extended.

Referring to FIGS. 1 and 2, the numeral 10 designates a telescopic crane boom in accordance with the invention which is understood to be adapted for mounting on the rotatable upper section of a mobile crane (not shown), as by means of a trunnion 11 at its base end and which is further understood to be pivotable in a vertical plane about trunnion 11 between raised and lowered positions by means of a hydraulic lift cylinder 13 which is pivotably connected to an attachment bracket 14 on the boom.

Boom 10 comprises a hollow base section 15, a hollow intermediate section 16 slideably and telescopically receivable within base section 15, and a hollow fly section 17 slideably and telescopically receivable within intermediate section 16. FIGS. 1 and 2 show the boom 10 fully retracted and fully extended, respectively. For purposes of discussion herein, sections 15 and 16 are referred to as an "outer" section relative to "inner" sections 16 and 17, respectively.

Means are provided to telescopically move intermediate section 16 relative to base section 15 and such means comprise an elongated rotatable screw 20 which is rotatably supported at its base end by and connects to rotatable shaft 21 of a conventional reversible hydraulic motor 22 which is rigidly supported by means of a motor mount 23 on or near the base end of base section 15. As FIGS. 1 through 4 show, screw 20 is provided therealong with a continuous first or primary thread 25 of predetermined lead and depth. First thread 25 threadedly and rotatably engages a first nut or threaded member 26 which is rigidly and non-rotatably supported, as by welding or other suitable means, on or near the base end of intermediate section 16. In operation, rotation of shaft 21 of motor 22 effects rotation of screw 20 and first thread 25 relative to nonrotatable first nut 26, and this in turn causes axial sliding relative movement of "inner" intermediate section 16 relative to stationary base section 15, such movement being in the extend or retract direction depending on the direction of rotation of motor shaft 21.

Adjustably movable support means are provided for supporting screw 20 intermediate its ends on the "outer" or base section 15. Such means comprise a second or secondary thread 30 of smaller lead and lesser or shallower depth than first thread 25 which is superimposed on first thread 25, as FIG. 3 and 4 best show. In an actual tested embodiment, primary thread 25 has a lead of 3" and a depth of 0.15" and secondary thread 30 had a lead of 1.5" and a depth of 0.050". Preferably, secondary thread 30 has a lead equal to half the lead of primary thread 25. Secondary thread 30 threadably and rotatably engages a second nut or threaded member 36 which is non-rotatably mounted on or integral with a support member 37 which is located between the motor 22 on base section 15 and first nut 26 on intermediate section 16. Support member 37 is supported for axial movement relative to base section 15 on the floor 38 of base section 15 by means of a roller or wheel 40 rotatably mounted at the lower end of the support member 37. Preferably, an upper roller or wheel 41 is rotatably mounted at the upper end of support member 37 and engages the top side 39 of base section 15 so as to guide, stabilize and prevent "window-locking" of secondary nut 36 on screw 20. In operation, rotation of screw 20 as hereinbefore described effects rotation of secondary thread 30 relative to non-rotatable second nut 36 and this in turn causes axial sliding relative movement of nut 36 and the attached support member 37 relative to stationary base section 15, such movement being in the extend or retract direction, depending on the direction of rotation of screw 20, at half the speed of the movement of boom section 16 relative to base section 15. In this manner, support member 37 is automatically positioned at or near the mid-point of that portion of screw 20 between motor shaft 21 and first nut 26, thus ensuring that screw 20 is supported from below at the optimum intermediate location. However, as FIGS. 3 and 4, show, because of a slight difference in pitch diameters between threads 25 and 30, a slight error difference results in the length of travel of nut 26 relative to nut 36 but this can be compensated for by initially locating support member 37 in an appropriate location.

Figure 3:
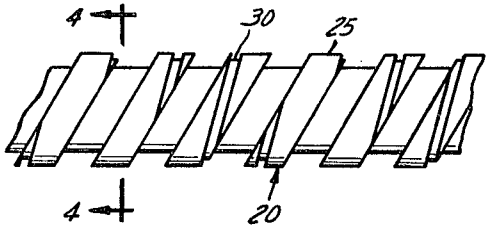
FIG. 3 is an enlarged side elevational view of a portion of the screw shown in FIGS. 1 and 2.
Figure 4:
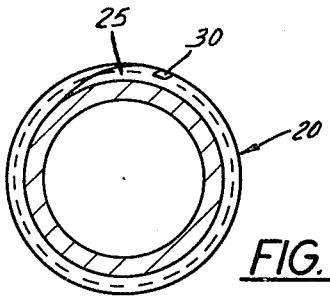
FIG. 4 is an enlarged cross-sectional view of the screw taken on line 4—4 of FIG. 3.

As FIGS. 3 and 4 show, means are also provided to telescopically move fly section 17 relative to intermediate section 16 and such means comprise an elongated rotatable screw 20A, a hydraulic motor 22A, a first thread 25A and a second thread 30A superimposed thereon, a first nut 26A, a second nut 36A, and a wheeled support member 37A. These last recited components having the suffix letter "A" are constructed and operate in the same manner as similarly numbered components without the suffix letter, hereinbefore described.

I claim:

1. In a telescopic boom:

a pair of relatively movable boom sections;

an elongated rotatable screw rotatably mounted on one boom section;

a primary thread on said screw engaged with a primary nut on the other boom section whereby screw rotation effects relative telescopic movement of said boom sections;

a secondary thread on said screw of different lead than said first thread and engaged with a secondary nut;

and a support connected to and movable with said secondary nut, said support being movably mounted on one of said boom sections whereby said screw rotation also effects axial movement of said support at a different rate than said telescopic movement of the boom sections to a supporting position wherein it supports said screw intermediately thereof.

2. A telescopic boom according to claim 1 wherein said secondary thread is superimposed on said primary thread.

3. A telescopic boom according to claim 1 or 2 wherein said secondary thread is of smaller lead than said primary thread.

4. A telescopic boom according to claim 1 or 2 wherein said support is movably mounted on said other boom section.

5. A telescopic boom according to claim 4 wherein said secondary thread is of smaller lead than said primary thread.

6. In a telescopic boom:

an inner boom section telescopically receivable within an outer hollow boom section;

an elongated screw rotatably mounted on said outer section by screw mounting means for telescopically moving the boom sections relative to each other, said screw having a first thread of predetermined lead therealong and a second thread of smaller lead superimposed on said first thread;

a first nut mounted on said inner boom section and in threaded engagement with said first thread whereby screw rotation effects telescopic movement of the inner boom section;

a second nut in threaded engagement with said second thread;

and a support connected to said second nut and movably mounted on said outer boom section between said screw mounting means and said first nut so as to support said screw on said outer boom section;

said screw rotation effecting axial movement of said support at a slower rate than said telescopic movement of said boom sections so that said support moves to a supporting location near the mid-section of said screw.

7. A telescopic boom according to claim 6 wherein the lead of said second thread is approximately half that of said first thread.

8. In a telescopic boom:

an inner boom section telescopically receivable within an outer hollow boom section;

an elongated rotatable screw for telescopically moving said inner boom section relative to said outer boom section, said screw having a first thread of predetermined lead therealong; said screw having a second thread of smaller lead than said first thread superimposed on said first thread;

mounting means on said outer boom section for rotatably mounting said screw thereon;

first screw-receiving means mounted on said inner boom section in threaded engagement with said first thread whereby screw rotation effects telescopic movement of said inner boom section relative to said outer boom section;

and second screw-receiving support means movably mounted on said outer boom section between said mounting means and said first screw-receiving means to support said elongated screw on said outer boom section and in threaded engagement with said second thread whereby screw rotation effects movement of said support means at a slower rate of movement than said telescopic movement.

* * * * *